United States Patent [19]

Manning

[11] 4,033,014

[45] July 5, 1977

[54] CONTINUOUS MOLDED SLIDE FASTENER STRINGER AND METHOD AND APPARATUS FOR MANUFACTURE

[75] Inventor: Harry F. Manning, Meadville, Pa.

[73] Assignee: Textron, Inc., Providence, R.I.

[22] Filed: May 17, 1976

[21] Appl. No.: 687,075

[52] U.S. Cl. ..... 24/205.16 R; 24/205.13 D

[51] Int. Cl.[2] ..... A44B 19/34

[58] Field of Search ..... 24/205.13 D, 205.12, 24/205.16 R

[56] References Cited

UNITED STATES PATENTS 3,414,948 12/1968 Cuckson ..... 24/205.13 D 3,757,391 9/1973 Cuckson ..... 24/205.13 D

*Primary Examiner*—Bernard A. Gelak

*Attorney, Agent, or Firm*—O'Brien & Marks

[57] ABSTRACT

Interconnecting threads for continuous molded coupling elements are used as load bearing members securing the coupling elements to a support tape. The strength of the union of the connecting threads with the molded coupling elements is increased such as by displacing central portions of embedded segments of the connecting threads deeper into leg portions of the coupling elements or providing a plurality of spaced connecting threads for each leg portion of a pair of leg portions of each element.

17 Claims, 13 Drawing Figures

FIG. 6
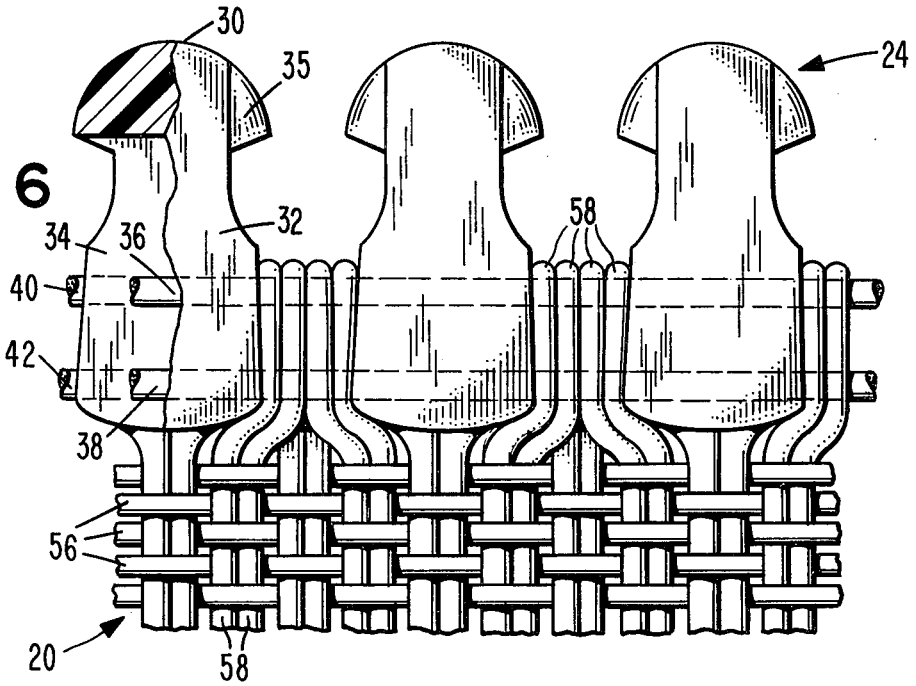
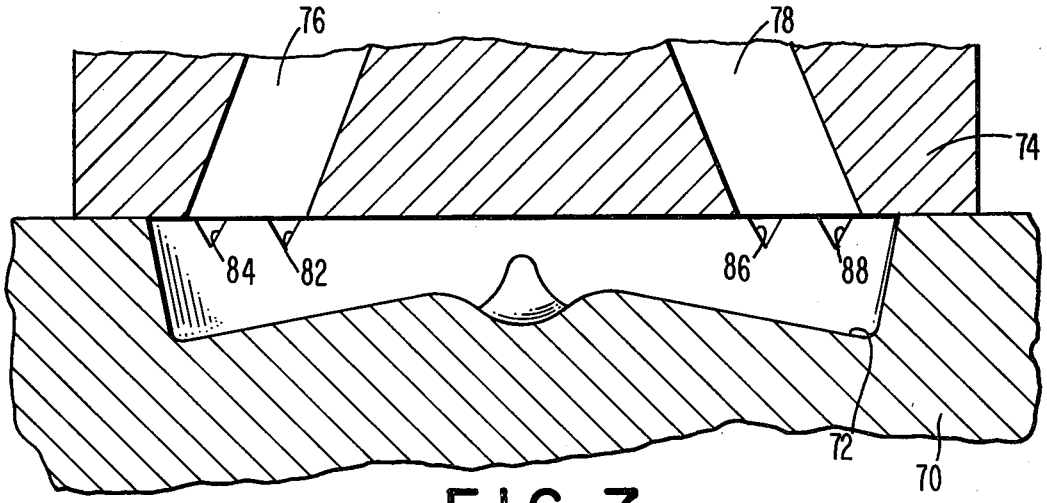
FIG. 7
FIG. 8
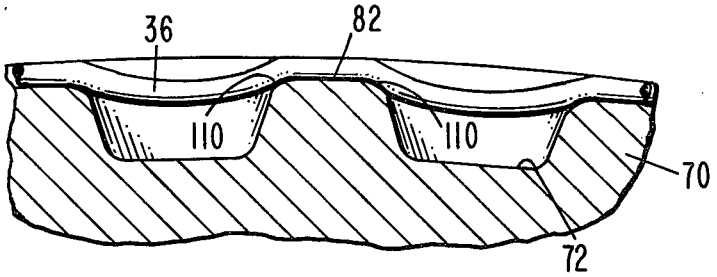

CONTINUOUS MOLDED SLIDE FASTENER STRINGER AND METHOD AND APPARATUS FOR MANUFACTURE

BACKGROUND OF THE INVENTION

1. Field of the Invention

The invention relates to slide fasteners, and particularly to slide fasteners employing coupling elements which are joined in a train by being molded around connecting threads and to methods and apparatus for manufacture of such slide fasteners.

2. Description of the Prior Art

The prior art, as exemplified in U.S. Pat. Nos. 3,328,857; 3,414,948; 3,445,915; 3,487,531; and 3,490,111, contains a number of slide fasteners employing continuous molded coupling elements with embedded connecting threads. The continuous molded coupling elements are formed by injecting molten thermoplastic resin into transverse elongated cavities in a periphery of a cavity wheel having annular grooves for receiving the connecting threads intersecting the cavities. The molded coupling elements are then bent into a U-shape and the leg portions thereof are secured to a tape by stitches, warp threads of a woven tape, or the like. Using the connecting threads to secure the prior art coupling elements to tapes such as by the weft threads of woven tapes, generally results in inferior slide fasteners due to a weakness of the union between the coupling elements and the connecting threads, a weakness of the connecting threads, or other deficiency.

SUMMARY OF THE INVENTION

The invention is summarized in a stringer for a slide fastener including a carrier tape, a train of spaced coupling elements disposed along one edge of the tape, each of the coupling elements having a head portion and a pair of leg portions extending from opposite sides of the head portion, each pair of the pairs of leg portions extending in substantially the same direction from the respective head portion, at least four spaced connecting threads, pairs of the connecting threads having respective spaced segments embedded in spaced relationship in respective leg portions of the pairs of leg portions to interconnect the coupling elements, and thread means encircling connecting threads between the coupling elements and securing the connecting threads to the one edge of the tape.

An object of the invention is to manufacture stringers employing embedded connecting threads joining a plurality of coupling elements in a train as load bearing members securing the coupling elements to a carrier tape.

Another object of the invention is to form a train of coupling elements having pairs of leg portions wherein each leg portion of each pair of leg portions is molded around a respective plurality of spaced connecting threads of a pair of pluralities of spaced connecting threads to provide greater improved means of attachment to a carrier tape.

It is also an object of the invention to provide connecting threads closer to head portions of coupling elements with greater longitudinal extensibility between the coupling elements than connecting threads closer to heels of the leg portions of the coupling elements.

One advantage of the invention is that by embedding at least a pair of spaced connecting threads in each leg of the coupling element, a rectangular, trapezoidal, or polygonal arrangement of connecting threads is formed, resulting in a more stable attachment to a tape to help maintain a planar relationship between the coupling elements and the tape.

One additional feature of the invention is the displacement of midportions of segments of connecting threads embedded in the legs of coupling elements so that the midportions are more deeply embedded in the legs and a stronger union is formed between the connecting threads and the coupling elements.

Other objects, advantages and features of the invention will be apparent from the following description of the preferred embodiment, taken in conjunction with the accompanying drawings.

BRIEF DESCRIPTION OF THE DRAWINGS

FIG. 6 is an enlarged plan view of a portion of one stringer of the fastener of FIG. 1.

FIG. 7 is front cross-section view taken as indicated at 7—7 in FIG. 5 of a portion of a cavity wheel and injection shoe of the molding apparatus.

FIG. 8 is a side view of the portion of cavity wheel shown in FIG. 7.

DESCRIPTION OF THE PREFERRED EMBODIMENT

Figure 1:
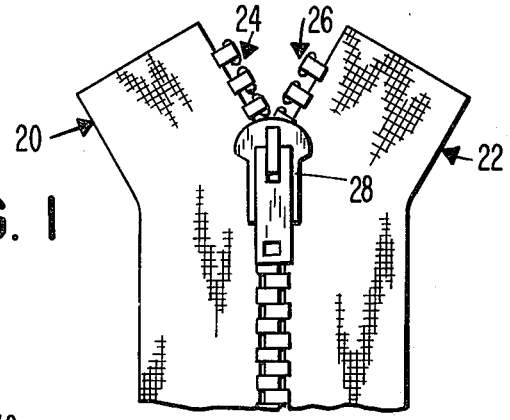
FIG. 1 is a plan view of a slide fastener manufactured in accordance with the invention.

As illustrated in FIG. 1, a slide fastener manufactured in accordance with the invention includes a pair of planar arranged tapes, indicated generally at 20 and 22, with trains of interlocking coupling elements, indicated generally at 24 and 26, secured to inner edges of the tapes 20 and 22. A slider 28 is slidably mounted along the coupling elements 24 and 26 for opening and closing the slide fastener. The tape 20 and the train of coupling elements 24 form a left stringer while the tape 22 and the train of coupling elements 25 form a right stringer for the slide fastener. Each of the left and right stringers are substantially identical except for being reversed.

Figure 2:
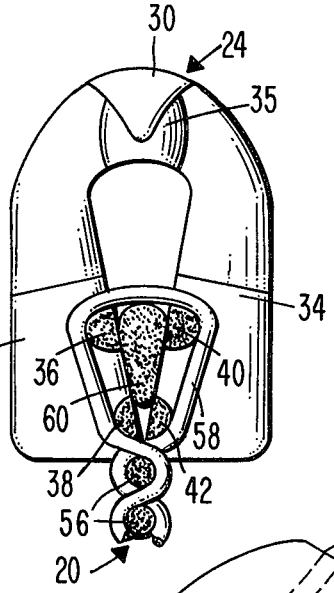
FIG. 2 is a cross-section view of a portion of one stringer of the fastener of FIG. 1.
Figure 3:
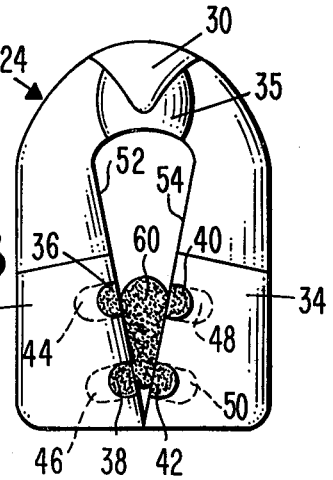
FIG. 3 is a view of a coupling element similar to FIG. 2 but at an intermediate step of manufacturing prior to attachment of a tape to the coupling element.

As shown in FIGS. 2 and 3, each of the coupling elements 24 has a head portion 30 and a pair of leg portions 32 and 34 extending generally in the same direction from opposite sides of the head portion 30. Suitable projections 35 are formed on the head portions 30 of the coupling elements 24 for interlocking with the mating coupling elements 26, FIG. 1. Connecting threads 36, 38, 40 and 42 extend generally parallel to the tape 20; one pair of the connecting threads 36 and 38 having respective spaced segments 44 and 46 embedded in the lower halves of the leg portions 32 and the other pair of the connecting threads 40 and 42 having spaced segments 48 and 50 embedded in the lower halves of the leg portions 34 to interconnect the coupling elements 24 in a train. Between the ends of the embedded segments 44, 46, 48 and 50 which enter the front and back sides of the leg portions 32 and 34 adjacent respective inner sides 52 and 54 of the leg portions 32 and 34, midportions of the segments 44, 46, 48 and 50 are each displaced or bowed from a straight line between the ends of the respective segment such that the midportions are deeply embedded in the leg portions (see FIG. 4).

The connecting threads 36 and 40 closer to the head portion 30 have a greater longitudinal extensibility between the coupling elements, such as being more elastic or having a greater fullness or slack, than the connecting threads 38 and 42 closer to the heels of the leg portions 32 and 34. The tape 20 includes a plurality of longitudinal warp threads 56 with an interwoven weft thread 58 which at one edge of the tape encircles the connecting threads 36, 38, 40 and 42 between the coupling elements 24 to secure the train of the coupling elements to the edge of the tape. In FIG. 6 two double picks or four loops of the weft thread 58 are shown encircling the connecting threads 36, 38, 40 and 42 between adjacent coupling elements 24 and substantially filling the spaces between the coupling elements. The illustrated stringer also includes an invested cord 60 extending between the leg portions 32 and 34 and which is encircled together with the connecting threads 36, 38, 40 and 42 by weft thread 58.

Having at least four connecting threads wherein a pair or a plurality thereof are embedded in spaced relationship in each of the lower halves of the two legs 32 and 34 of the coupling elements 24 results in a substantially stronger attachment to the tape 20 than is possible in stringers employing single threads embedded in each leg section of continuous molded coupling elements. Utilizing single threads of a large size in the leg portions displaces a large quantity of the polymer material in the leg portions greatly reducing the strength of the leg portions whereas having a plurality of smaller threads embedded in spaced relationship in each leg portion provides substantially improved strength in the connecting threads without substantially reducing the strength of the leg portions. Thus where the connecting threads are load bearing members used to attach the coupling elements to the tape, a substantially stronger union of the coupling elements and tape is formed by the plurality of spaced connecting threads for each leg portion of the coupling elements.

Also having four or more spaced connecting threads arranged at the corners of a cross sectional polygon results in a relatively large polygonal arrangement, such as a generally rectangular or trapezoidal arrangement of the threads 36, 38, 40 and 42, which produces a more stable attachment to the edge of the tape and produces more even distribution of stress. The relatively large polygonal arrangement as opposed to lesser closely spaced threads provides a larger support area which has less tendency to permit twisting of the coupling elements and thus maintains the coupling elements and tape in planar relationship.

The threads nearest the head portions having greater extensibility between the coupling elements allows the coupling elements to work in a normal fashion and prevents undue stress on the threads nearest the head portions. A particular advantage is noted where the coupling elements take an arcuate path through the slider; the greater extensibility of the connecting threads nearest the head portions permits a greater chord length in the arcuate path of those connecting threads nearest the head portion resulting in less stress on such threads and easier operation of the slide fastener.

By substantially filling the spaces between the coupling elements with at least two loops of the weft thread or preferably four loops as shown in FIG. 6 when the size of the threads permit, a more reliable and stable stringer is produced. Maintenance of the spacing between the coupling elements is aided by the loops to make the stringer more reliable. The stability of the attachment of the coupling elements on the edge of the tape is improved by having at least two loops between the coupling elements and even more greatly by the four loops; the plurality of loops form a broadened support between coupling elements and more widely distribute crosswise forces.

Additionally, having the embedded segments 44, 46, 48 and 50 of the connecting threads 36, 38, 40 and 42 embedded deeply in the leg portions 32 and 34 by having the midportions of the embedded segments bowed or displaced from a straight line between the ends of the embedded segments produces a substantially increased strength of union of the threads 36, 38, 40 and 42 to the coupling elements while permitting closer arrangements of the threads 36, 38, 40 and 42 to the plane of the tape 20 between the coupling elements 24. Such closer arrangement resulting from the threads 36, 38, 40 and 42 exiting adjacent the inner surfaces 52 and 54 of the leg portions makes the train of coupling elements more flexible perpendicular to the planes of the tapes and causes less distortion of the connecting threads, particularly the threads 38 and 42, by the weft thread 58. This less distortion of the connecting threads between the coupling elements by the attaching threads results in substantially more even spacing between coupling elements of the stringer, and thus a more reliable slide fastener, since the amount of such distortion varies and cannot be accurately controlled.

Figure 4:
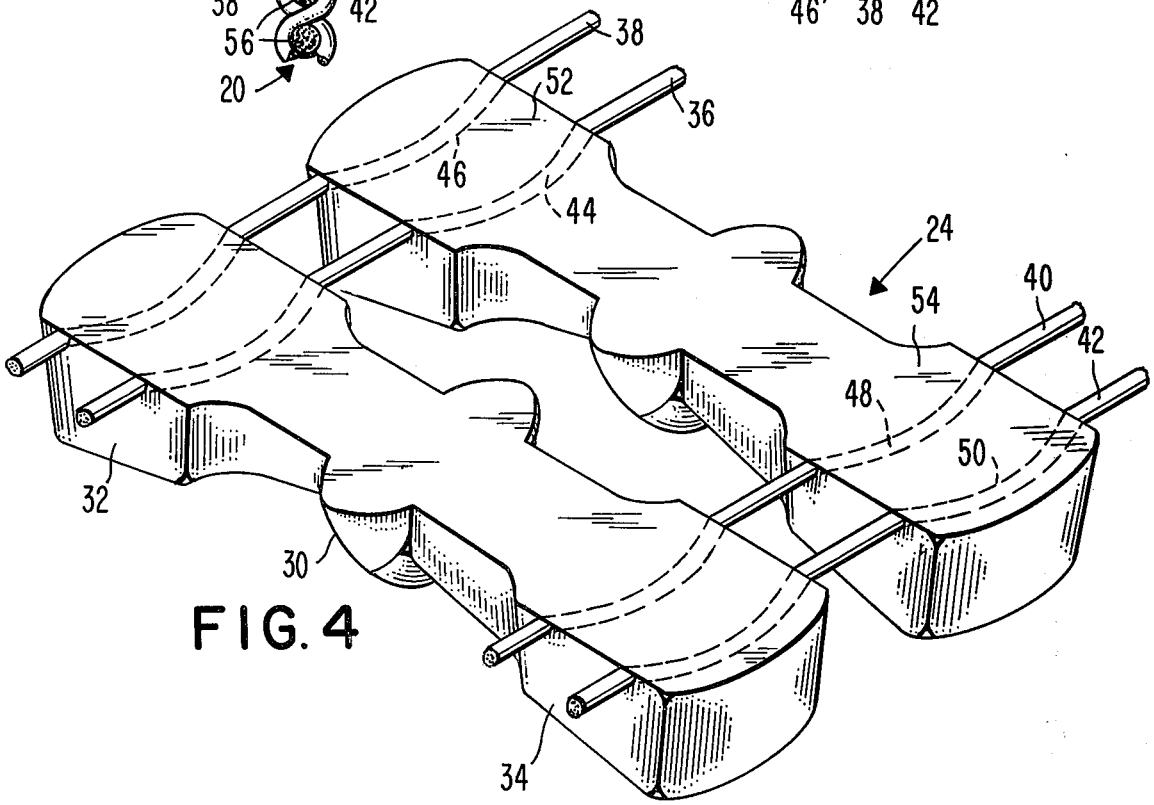
FIG. 4 is a perspective view of a train of coupling elements at an even earlier step of manufacture than in FIG. 3.
Figure 5:
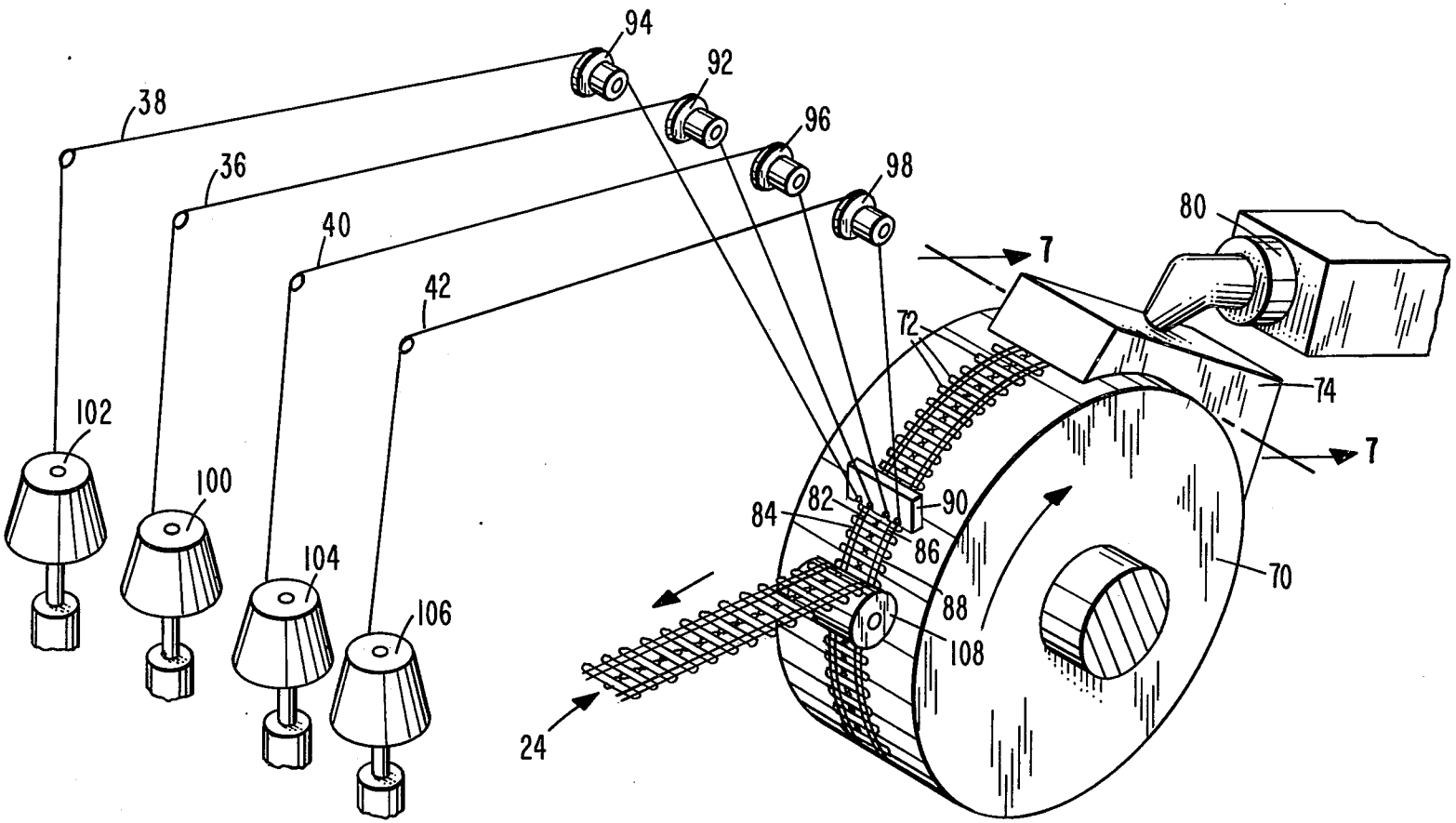
FIG. 5 is a perspective view of an apparatus for molding the train of coupling elements in FIG. 4.

An apparatus, shown in FIGS. 5, 7, and 8, for manufacturing a train of the coupling elements in an unfolded condition, as shown in FIG. 4, includes a rotatably driven cavity wheel 70 having a row of elongated molding cavities 72 formed in the periphery of the cavity wheel 70 wherein the elongated cavities extend parallel to the axis of the cavity wheel 70. The cavities 72 have a shape corresponding to the desired shape of the coupling elements 24. An injection shoe 74 slidingly engages the periphery of the cavity wheel 70 and has passageways 76 and 78 communicating from a molten synthetic polymer resin source 80 to the cavities 72 as they pass beneath the shoe 74. Annular grooves 82, 84, 86 and 88 are formed in the periphery of the cavity wheel 70 intersecting the end portions of the cavities 72 corresponding to the leg portions of the coupling elements for receiving the connecting threads 36, 38, 40 and 42. A thread guide 90 and adjustable thread tensioning devices 92, 94, 96 and 98 are suitably arranged between supplies 100, 102, 104, and 106 of the threads 36, 38, 40 and 42 for properly tensioning the threads and guiding the threads to the grooves 82, 84, 86, and 88. A roller 108 is positioned to guide and strip the train of coupling elements 24 from the cavity wheel 70 after the molten polymer has been hardened.

The passageways 76 and 78 for the molten synthetic polymer open into the cavities 72 directly above the grooves 82, 84, 86 and 88 for forcing midportions of the segments of the connecting threads 36, 38, 40 and 42 extending across the cavities downward into the cavities (see FIG. 8) by the force of the flow of molten polymer when the tensioning devices 92, 94, 96 and 98 are properly set. Additionally, the openings of the grooves 82, 84, 86 and 88 into the cavities 72 have bottoms 110 which are tapered downwardly into the cavities 72 to promote the downward bowing or displacement of the midportions of the thread segments extending across the cavities. To provide for a greater fullness or slack in the threads 36 and 40 between coupling elements 24, the tensioning devices 92 and 96 are set to produce less tension on the threads 36 and 40 than is produced on the threads 38 and 42 by the tensioning devices 94 and 98.

In operation of the apparatus shown in FIGS. 5, 7 and 8, the cavity wheel 70 is rotated as the threads 36, 38, 40 and 42 are fed over the tensioning devides 92, 94, 96 and 98 and the thread guide 90 into the grooves 82, 84, 86 and 88 on the periphery of the cavity wheel 70. Molten synthetic polymer resin is forced from the source 80 into the shoe 74 and through passages 76 and 78 causing downward displacement of the midportions of the segments of thread within the cavities 72 to deeply embed the connecting threads 36, 38, 40 and 42 in the leg portions formed in the opposite ends of the cavities 72. After hardening, the train of coupling elements 24 is stripped and guided from the cavity wheel 70 by the roller 108.

Subsequently the leg portions 32 and 34 of the coupling elements 24 are bent together as shown in FIG. 3 while the invested cord 60 is positioned between the leg portions 32 and 34. The bent train of coupling elements 24 with the invested cord 60 is then passed to a conventional slide fastener tape weaving apparatus wherein the weft thread 58 is interwoven with the warp threads 56 and the train of coupling elements 24 to form a stringer for the slide fastener.

Figure 9:
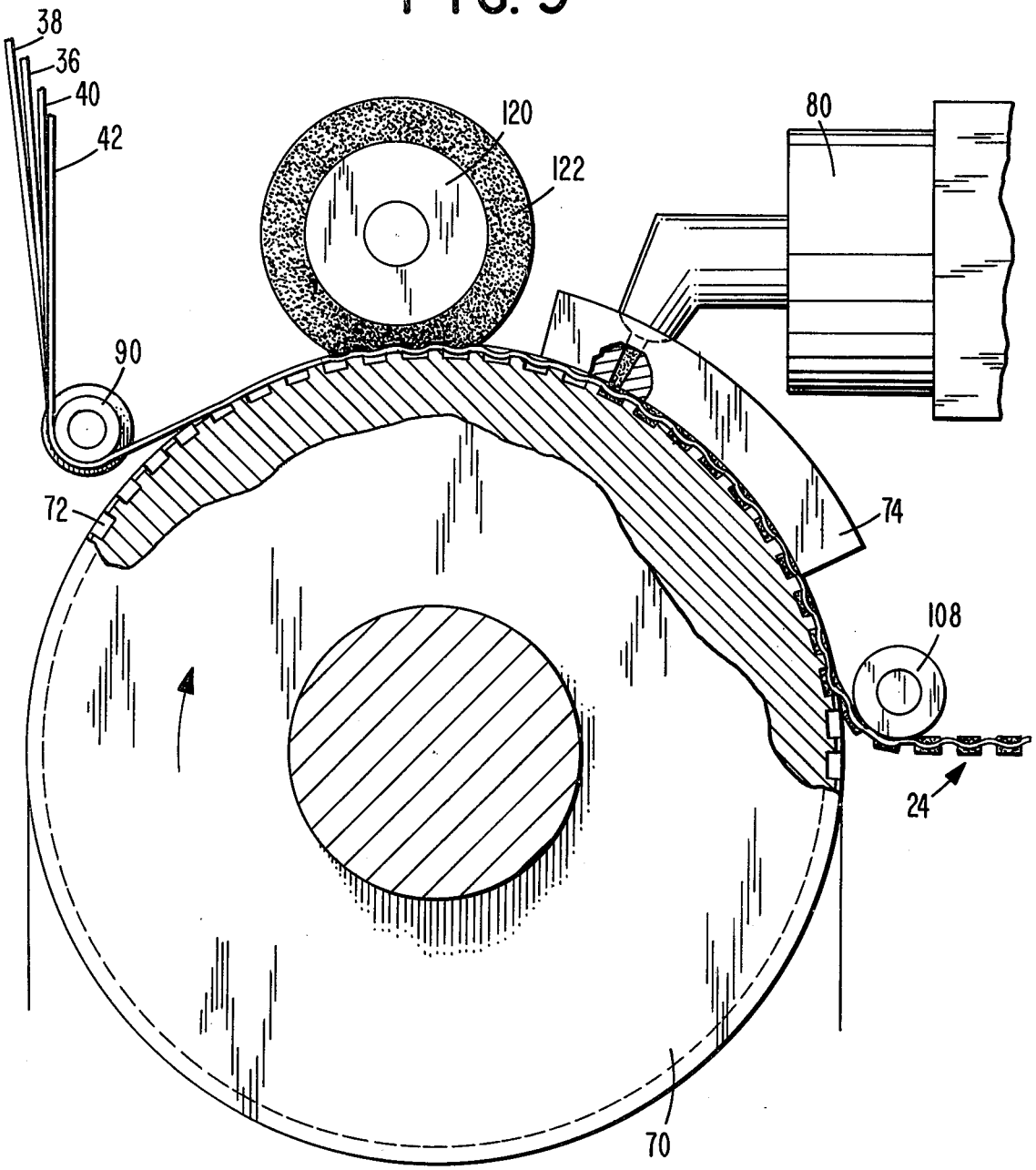
FIG. 9 is a side view, partially in cross-section, of a modified molding apparatus for forming a train of the coupling elements.

A variation, shown in FIG. 9, of the apparatus for continuously molding the coupling elements 24 has parts identified by the same numerals used to identify parts of the apparatus in FIGS. 5, 7, and 8 indicating that such commonly identified parts have substantially the same structure and/or function. The variation includes a wheel 120 with a rubber or elastomeric surface 122 engaging the periphery of the cavity wheel 70 after the threads 36, 38, 40 and 42 have been laid in the grooves in the periphery of the cavity wheel but prior to the shoe 74 for pressing the threads 36, 38, 40 and 42 into the cavities 72 to cause inward bowing or displacement of the thread sections to be embedded within the coupling elements. The elastomeric wheel 120 can be used as alternative or in addition to the inflow of polymer into the cavities to produce deeply embedded midportions of the embedded segments.

Figure 10:
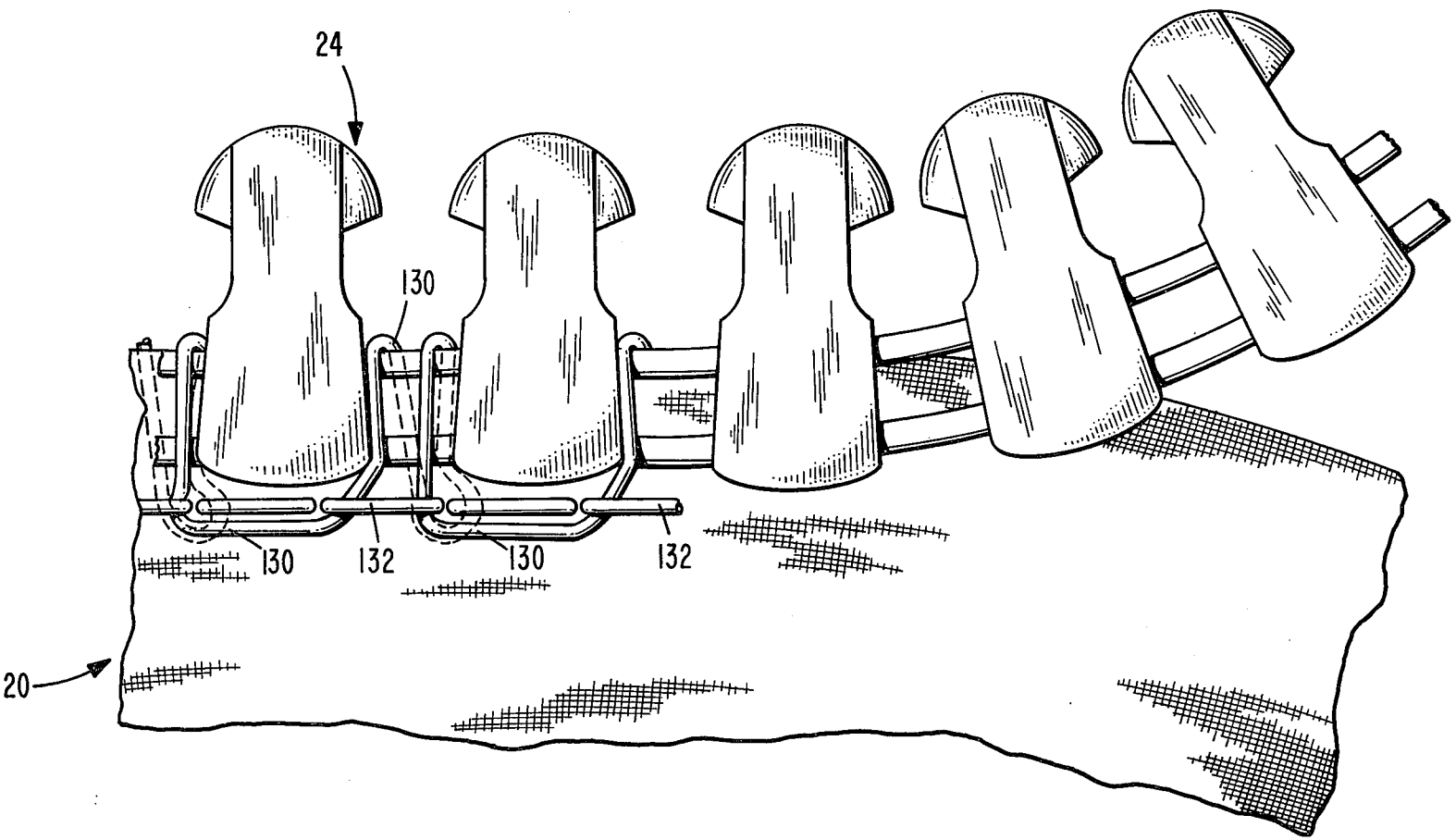
FIG. 10 is an enlarged plan view of a variation of the stringer shown in FIG. 6 during assembly of the coupling elements on a tape.
Figure 11:
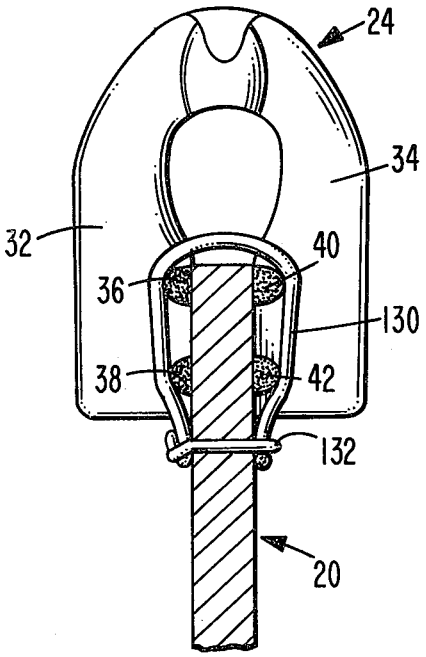
FIG. 11 is a cross-section view of the assembled stringer of FIG. 10.
Figure 12:
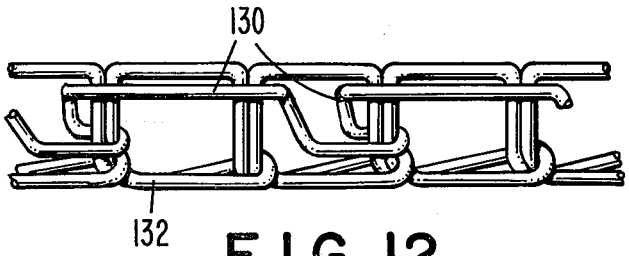
FIG. 12 is a bottom view of stitching used in attaching the coupling elements to the tape in the stringer of FIGS. 10 and 11.

In FIGS. 10 and 11 there is shown a variation of the stringer wherein the coupling elements 24 are stitched to the tape 20. The edge of the tape 20 is positioned between the leg portions 32 and 34 of the coupling elements. A thread 30 is looped over the connecting threads 36, 38, 40, and 42 to encircle the connecting threads and is secured to the tape by a chain stitch 132. The particular arrangement of the looped thread 130 and the chain stitch 132 used in the variation of FIGS. 10 and 11 is more clearly shown in FIG. 12.

Figure 13:
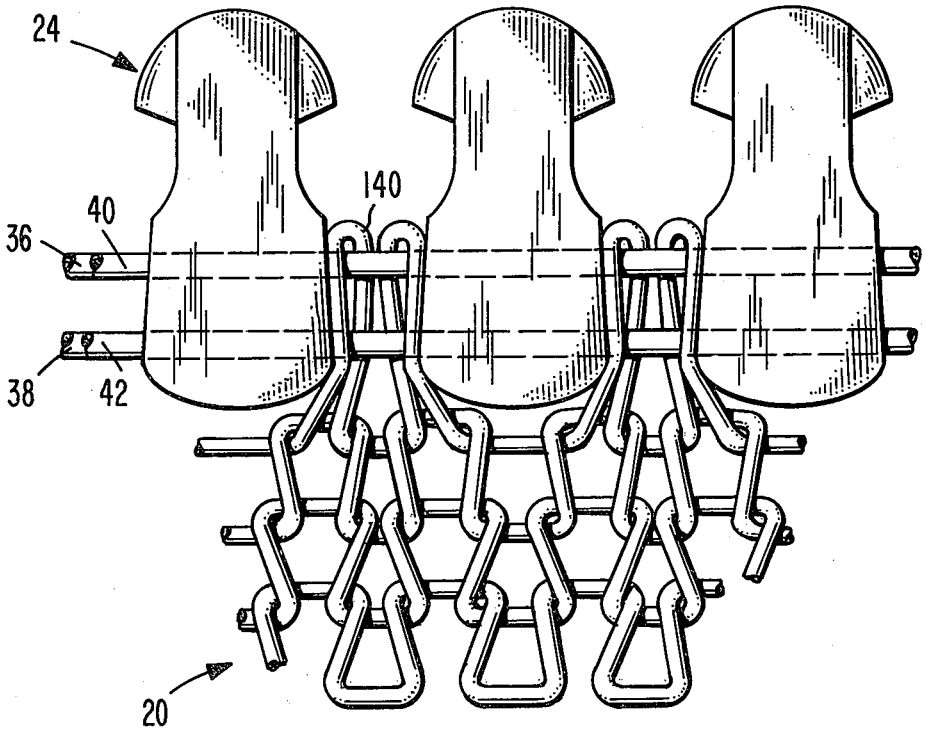
FIG. 13 is an enlarged plan view of another variation of the stringer shown in FIGS. 6 and 10.

The coupling element 24 can also be secured to a tape which is knitted as shown in FIG. 13 wherein a knitted thread 140 surrounds or encircles the connecting threads 36, 38, 40 and 42 to secure the train of coupling elements 24 to the edge of the tape 20.

Since many variations, modifications and changes in detail may be made to the above described embodiments it is intended that all matter in the foregoing description and shown in the accompanying drawings be interpreted as illustrative and not in a limiting sense.

What is claimed is:

1. A stringer for a slide fastener comprising
a carrier tape,
a train of spaced coupling elements disposed along one edge of the tape,
each of said coupling elements having a head portion and a pair of leg portions extending from opposite sides of the head portion,
each pair of said pairs of leg portions extending in substantially the same direction from the respective head portion,
at least four spaced connecting threads,
pairs of said connecting threads having respective spaced segments embedded in spaced relationship in respective leg portions of the pairs of leg portions to interconnect the coupling elements, and
thread means encircling the connecting threads between the coupling elements and securing the connecting threads to the one edge of the tape.

2. A stringer as claimed in claim 1 wherein one connecting thread of each pair of connecting threads closer to the head portion has greater longitudinal extensibility between the coupling elements than the other of each pair of connecting threads closer to the heel of the respective leg portion.

3. A stringer as claimed in claim 2 wherein the one connecting threads have greater elasticity than the other connecting threads.

4. A stringer as claimed in claim 2 wherein the one connecting threads have greater fullness than the other connecting threads.

5. A stringer as claimed in claim 1 wherein segments of the connecting threads embedded in the leg portions have ends entering the front and back sides of the respective leg portions adjacent inner sides of the leg portions, the embedded segments have midportions which are displaced from straight lines between the ends of the embedded segments such that the midportions are deeply embedded in the leg portions.

6. A stringer as claimed in claim 5 wherein one connecting thread of each pair of connecting threads closer to the head portion has greater longitudinal extensibility between the coupling elements than the other of each pair of connecting threads closer to the heel of the respective leg portion.

7. A stringer for a slide fastener as claimed in claim 1 wherein the pairs of connecting threads embedded in the respective leg portions are embedded in the lower halves of the leg portions.

8. A stringer for a slide fastener as claimed in claim 1 wherein the connecting threads between the coupling elements are arranged to form spaced corners of a polygon, and the thread means encircles the polygonal arrangement of connecting threads.

9. A stringer for a slide fastener as claimed in claim 1 wherein the thread means encircling the connecting threads includes at least two loops encircling the connecting threads in each space between the coupling elements.

10. A stringer for a slide fastener as claimed in claim 9 wherein the loops encircling the connecting threads substantially fill the spaces between the coupling elements.

11. A stringer for a slide fastener as claimed in claim 9 wherein the thread means encircling the connecting threads includes at least four loops encircling the connecting threads in each space between the coupling elements.

12. A stringer for a slide fastener as claimed in claim 1 wherein the tape is a woven tape having a plurality of warp threads and a weft thread interwoven with the warp threads, and the thread means encircling the connecting threads includes a plurality of loops of the weft thread.

13. A stringer for a slide fastener as claimed in claim 1 wherein the thread means includes stitching securing the connecting threads to the tape.

14. A stringer for a slide fastener as claimed in claim 1 wherein the tape is a knitted tape, and the thread means encircling the connecting threads includes a knitted thread looped around the connecting threads.

15. A stringer for a slide fastener as claimed in claim 1 wherein the coupling elements are initially formed in a flat condition with the leg portions extending in opposite directions from the respective head portions by solidifying a molten polymer resin on the connecting threads, and the initially formed leg portions are subsequently bent from the flat condition to extend substantially in the same direction from the respective head portions.

16. A stringer for a slide fastener comprising a carrier tape, a train of molded synthetic polymer resin coupling elements disposed in spaced relationship along one edge of the tape, each of said coupling elements having a head portion and a pair of leg portions extending from opposite sides of the head portion, each pair of said pairs of leg portions being bent to extend in substantially the same direction from the respective head portion, at least two connecting threads, each of said two connecting threads having spaced segments embedded in respective leg portions of the pairs of leg portions to interconnect the coupling elements, said embedded segments at their opposite ends entering the front and back sides of the respective leg portions adjacent inner sides of the leg portions, the embedded segments having midportions being displaced from straight lines between the ends of the embedded segments such that the midportions are deeply embedded in the leg portions, and thread means encircling the connecting threads between each of the coupling elements and securing the connecting threads to the one edge of the tape.

17. A stringer for a slide fastener as claimed in claim 16 wherein said embedded segments are bowed between their opposite ends.

* * * * *